US006680571B1

(12) United States Patent
Giorgi et al.

(10) Patent No.: US 6,680,571 B1
(45) Date of Patent: Jan. 20, 2004

(54) DEVICE FOR INTRODUCING SMALL AMOUNTS OF MERCURY INTO FLUORESCENT LAMPS

(75) Inventors: Stefano Paolo Giorgi, Biassono (IT); Mario Borghi, Barlassina (IT)

(73) Assignee: SAES Getters S.p.A., Milan (IT)

( * ) Notice: Subject to any disclaimer, the term of this patent is extended or adjusted under 35 U.S.C. 154(b) by 0 days.

(21) Appl. No.: 09/441,972

(22) Filed: Nov. 17, 1999

Related U.S. Application Data

(63) Continuation of application No. PCT/IT98/00117, filed on May 12, 1998.

(30) Foreign Application Priority Data

May 22, 1997 (IT) ..... MI97A1202

(51) Int. Cl.[7] ..... H01J 9/395
(52) U.S. Cl. ..... 313/565; 313/566; 252/181.6
(58) Field of Search ..... 313/550, 564, 313/565, 566; 252/181.1, 181.2, 181.6

(56) References Cited

U.S. PATENT DOCUMENTS

| | | | | | |
|---|---|---|---|---|---|
| 3,657,589 | A | * | 4/1972 | Della Porta et al. | 313/178 |
| 3,764,842 | A | | 10/1973 | Ridders et al. | |
| 3,794,402 | A | | 2/1974 | Ridders et al. | |
| 3,983,440 | A | | 9/1976 | Scott et al. | |
| 4,056,750 | A | | 11/1977 | Latassa | |
| 4,107,565 | A | * | 8/1978 | Isojima et al. | 313/174 |
| 4,182,971 | A | | 1/1980 | Cassidy et al. | |
| 4,278,908 | A | | 7/1981 | Antonis | |
| 4,282,455 | A | * | 8/1981 | Latassa et al. | 313/546 |
| 4,288,715 | A | * | 9/1981 | van Overveld et al. | 206/6 |
| 4,542,319 | A | * | 9/1985 | Grenfell et al. | 313/546 |
| 4,754,193 | A | | 6/1988 | Holmes et al. | |
| 4,808,136 | A | * | 2/1989 | Schuster | 205/558 |
| 4,823,047 | A | | 4/1989 | Holmes et al. | |
| 4,990,828 | A | * | 2/1991 | Rabusin | 313/546 |
| 5,204,584 | A | * | 4/1993 | Ikeda et al. | 313/490 |
| 5,520,560 | A | * | 5/1996 | Schiabel et al. | 445/9 |
| 5,572,088 | A | * | 11/1996 | Aizawa et al. | 313/491 |
| 5,672,936 | A | * | 9/1997 | Hatsutori et al. | 313/491 |
| 5,876,205 | A | * | 3/1999 | Schiabel et al. | 445/9 |
| 5,916,479 | A | * | 6/1999 | Schiabel et al. | 252/181.3 |
| 6,107,737 | A | * | 8/2000 | della Porta | 313/556 |
| 6,169,361 | B1 | * | 1/2001 | Boffito et al. | 313/553 |

FOREIGN PATENT DOCUMENTS

| | | |
|---|---|---|
| EP | 0 091 297 A2 | 10/1983 |
| EP | 0 479 259 A2 | 4/1992 |
| EP | 0 479 259 A3 | 4/1992 |
| EP | 0 568 317 A1 | 11/1993 |
| EP | 0 669 639 A1 | 8/1995 |
| EP | 0 737 995 A2 | 10/1996 |
| EP | 0 737 995 B1 | 6/2000 |
| EP | 0 691 670 B1 | 3/2002 |
| GB | 799291 | 8/1958 |
| GB | 1 333 724 | 10/1973 |
| GB | 2 056 490 A | 3/1981 |
| JP | 06-302267 A | 10/1994 |
| JP | 07141993 | 6/1995 |
| JP | 07192689 | 7/1995 |
| JP | 09-045280 A | 2/1997 |
| JP | 2858803 B2 | 2/1999 |

* cited by examiner

*Primary Examiner*—Nimeshkumar D. Patel
*Assistant Examiner*—Glenn D. Zimmerman
(74) *Attorney, Agent, or Firm*—Akin, Gump, Strauss, Hauer & Feld, L.L.P.

(57) ABSTRACT

A device and a method are disclosed for introducing into the fluorescent lamps small amounts of mercury. The device is formed of a metallic container which is capable of containing powders of one or more compounds having the general formula $Ti_xZr_yHg_z$, but is not hermetically sealed, in order to allow the discharge of mercury vapors generated by the decomposition of such compounds. Some possible device geometries are disclosed, as well as some possible arrangements of the same inside lamps. Finally a method is disclosed for introducing mercury into a lamp by means of a device of the invention, without the device remaining in the resulting lamp.

20 Claims, 5 Drawing Sheets

30
34
34'
35
32
31
33

40
41
42
43
44
43'
45

DEVICE FOR INTRODUCING SMALL AMOUNTS OF MERCURY INTO FLUORESCENT LAMPS

CROSS-REFERENCE TO RELATED APPLICATION

This application is a continuation of International Application No. PCT/IT98/00117, filed May 12, 1998, the disclosure of which is incorporated herein by reference.

BACKGROUND OF THE INVENTION

The present invention relates to a device for introducing small amounts of mercury into fluorescent lamps and to the lamps thus obtained.

As it is known, the fluorescent lamps require small amounts of mercury for their working. As a result of the technological development, and of international standards more and more strict about the industrial use of potentially harmful substances such as indeed mercury, the maximum amount of this element being used in the lamps has been reduced in the last years from 20–30 mg per lamp to about 3 mg per lamp, and at present some manufacturers demand to be able to dose even smaller amounts of mercury.

Many of the conventional methods for dosing the mercury are not capable to meet these demands.

For example, the mercury volumetric dosing in the lamps in form of liquid droplets of the pure element is by now practically inapplicable: in fact, a mercury droplet of 1 mg has a volume of about 0.07 $\mu$l, and the volumetric dosing of so small element amounts is exceedingly complex, and anyhow the reproducibility of the element weight for the following dosings is very low. Furthermore, the dosing of liquid mercury directly into the lamps causes pollution problems of the working environment due to the high vapor pressure of this element.

Other methods involve the introduction of mercury into the lamps in form of pure element contained in little glass capsules, as disclosed e.g. in patents U.S. Pat. No. 3,794,402, U.S. Pat. No. 4,182,971, and U.S. Pat. No. 4,278,908, or in little capsules made of metal, as disclosed e.g. in patents U.S. Pat. No. 3,764,842, U.S. Pat. No. 4,056,750, U.S. Pat. No. 4,282,455, U.S. Pat. No. 4,542,319, U.S. Pat. No. 4,754,193 and U.S. Pat. No. 4,823,047. However, by using these little capsules, the aforementioned problem of an accurate and reproducible dosing of very small amounts of liquid mercury is not solved.

U.S. Pat. No. 4,808,136 and patent application EP 568,317 disclose the use of pellets or little spheres, made of porous material, being impregnated with mercury, which is subsequently released by heating once the lamp is sealed. However, also these methods need complex operations in order to load the mercury into the pellets, and the released mercury amount is hardly reproducible. Furthermore, by these methods the problem of mercury vapors polluting the working environment is not solved.

U.S. Pat. No. 3,657,589, in the applicant's name, represents the closest prior art and discloses the use of intermetallic mercury compounds having the general formula $Ti_xZr_yHg_z$, wherein x and y range from 0 to 13, the sum (x+y) ranges from 3 to 13 and z is 1 or 2; these compounds will be hereinafter also referred to as mercury releasing compounds. The dosing of small mercury amounts by means of any of these compounds is rather simple, since it is possible e.g. to laminate powders of the compound on a metal tape, and, by adjusting thickness and width of the powder track on the tape, predetermined values may be obtained for the linear loading, measured as mg of mercury per tape centimeter. The use of the compound $Ti_3Hg$, manufactured and sold by the applicant under the tradename St505, is specially advantageous; in particular, the compound St505 is sold in form of powder compressed in a ring-shaped container, or as powder compressed in pellets or tablets, under the trademark STAHGSORB®, or in form of powders laminated onto a metal tape, under the trademark GEMEDIS®. Once the compound is introduced into the lamp, e.g. in form of a piece of laminated tape, the mercury is released upon heating the compound at a temperature higher than 550° C., by a so-called "activation" operation; the heating treatment may be carried out e.g. by irradiating with radiofrequencies from outside the lamp the tape carrying the compound. However, the problem found by using these compounds is that the mercury released during the activation step is about 30–40% of the total mercury. This results in the necessity of introducing into the lamp an amount of mercury (in form of any of the aforementioned releasing compounds about 2–3 times greater than the amount required for the lamp working. The mercury in excess remains in the lamp as its service life ends, possibly resulting in disposal problems.

Published patent application EP 91,297 discloses a device for the mercury release which is formed of a metallic container completely closed, wherein there is a mixture composed of $Ti_3Hg$ or $Zr_3Hg$ and powders of nickel (Ni) or copper (Cu). According to this document, the addition of Ni and Cu to the mercury releasing compounds causes the system melting, thus favoring the release of nearly all the mercury in a few seconds. The container is closed by means of a steel, copper or nickel sheet, which is broken during the activation by the mercury vapor pressure generated in the container. This solution is not completely satisfying, because the mercury discharge is violent, possibly resulting in damages of tube portions, and furthermore the container assembling is very complex, requiring welding on small-size metal members.

U.S. Pat. No. 5,520,560 and published patent applications EP 691,670 and EP 737,995, all in the applicant's name, disclose combinations of materials comprising any of the aforementioned $Ti_xZr_yHg_z$, compounds and an alloy of copper with one or more elements selected among tin, indium, silver, silicon or rare earths. These copper alloys act as promoters for the mercury emission, allowing an element release greater than 80% during the activation step. These combinations of materials solve the problems affecting other methods for introducing mercury into the lamps, and allow the dosing of small mercury amounts, with the sole drawback of requiring a second component besides the mercury releasing compound.

It is the object of the present invention to provide a device for accurately and reproducibly introducing small mercury amounts into fluorescent lamps, without having to use a second component, as well as to provide the lamps obtained by use of the device.

SUMMARY OF THE INVENTION

According to the present invention, these objects are achieved by using a mercury releasing device which is formed of a metallic container being capable of retaining powders but not completely closed, containing at least a mercury releasing compound selected among the $Ti_xZr_yHg_z$, compounds, wherein x and y range from 0 to 13, the sum (x+y) ranges from 3 to 13 and z is 1 to 2.

The container of the device of the invention may have any shape, provided it is capable of retaining the powder particles of the $Ti_xZr_y,Hg_z$, compound used, and provided the container is not completely closed, having on at least a portion of its surface micro-holes or slits for the mercury discharge.

As already said, the $Ti_xZr_yHg_z$ compounds, when used in the known devices, in form of powder pellets, contained in open containers or laminated onto tapes, during the activation step release mercury amounts not greater than 40% of the element content. It has been found that, when these compounds are used alone in the devices of the invention, the mercury yield during the activation step is at least 80% of the total amount. It is therefore possible to introduce in the lamp a smaller mercury amount with respect to the known devices comprising the $Ti_xZr_yHg_z$ compounds, being practically the mercury amount actually required.

BRIEF DESCRIPTION OF SEVERAL VEWS OF THE DRAWINGS

The invention will be hereinafter described with reference to the drawings, wherein.

DETAILED DESCRIPTION OF THE INVENTION

Figure 1:
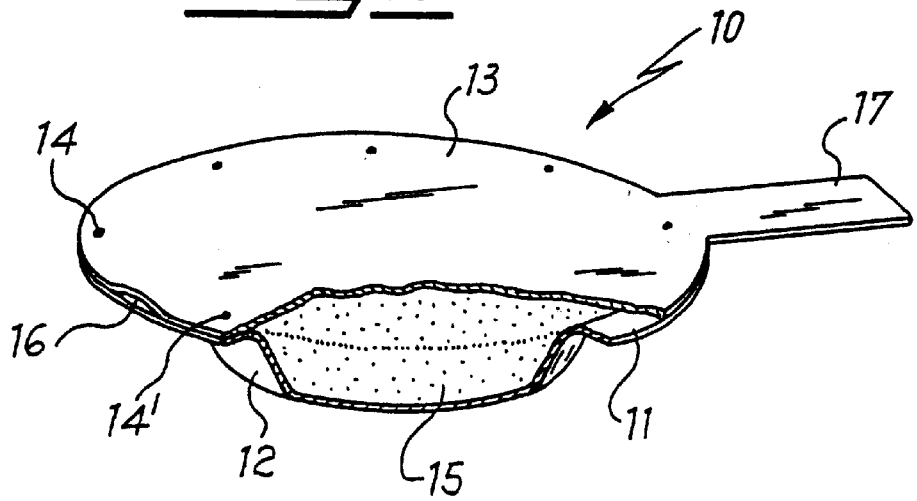
FIGS. 1, 2 and 3 show some possible devices for the mercury release according to the invention.

The material for the mercury release is a compound or a mixture of compounds having the general formula $Ti_xZr_yHg_z$, disclosed in the aforementioned U.S. Pat. No. 3,657,589, which is referred to as to the preparation and the working properties of the same compounds. The aforementioned $Ti_3Hg$ compound, manufactured and sold by the applicant under the tradename St505, is preferably used. The releasing compound is preferably used in form of powder having particle size smaller than about 150 $\mu$m.

The device may contain the releasing compound alone or in admixture with other materials possibly having different functions. For example, it is possible to use a mixture of the mercury releasing compound and of a getter alloy, which goal is to fix traces of gases harmful for the lamp working, such as carbon oxides, water, oxygen or hydrogen, according to modalities well known in the field. Among these alloys, the alloy having weight composition Zr 84% - Al 16%, manufactured and sold by the applicant under the trademark St 101®, may be mentioned, as well as the alloy having weight composition Zr 76.6% - Fe 23.4%, manufactured and sold by the applicant under the trademark St 198™ and the alloy having weight composition Zr 70% - V 24.6% - Fe 5.4%, manufactured and sold by the applicant under the tradename St 707™. It is also possible to add one of the aforementioned copper-based promoter alloys to the mercury releasing compound; in this case their use is not required for obtaining during the activation step a good mercury yield, already ensured by the devices of the invention containing only the releasing compound, but, the yield being equal, they may reduce the mercury release time. Another object that may be achieved by adding a second component to the releasing compound is to reduce the compound load in the device: for example, by loading the device with a mixture 1:1 by volume of the releasing compound and of another component, the powder volume being the same, the milligrams of mercury are reduced by half; thus devices may be obtained loaded with extremely small mercury amounts, even smaller than 1 mg, without using exceedingly small-sized devices which could cause problems in the production process. If a low mercury loading in the device is desired, while not wanting to use a second active component such as the aforementioned getter or promoter alloys, it is also possible to add a non-active compound, such as e.g. alumina, silica or the like, to the releasing compound. Also the components added to the releasing compound are preferably used in form of powders having particle size smaller than 150 $\mu$m. The weight ratio between the mercury releasing compound and one or more of the other compounds which may be used in the device of the invention is not critical, provided the device contains the desired mercury amount.

The container may be made of any metal. Due to reasons of cost, workability and low gas emission at high temperatures, steels, nickel, or nickeled iron are preferably used. The metal sheet the container is formed of is generally 50–300 $\mu$m thick.

The device of the invention may have any shape, provided the container is capable of retaining the powders of the mercury releasing compound and has openings, being smaller than the powder particle size, which allow the discharge of the mercury vapors. These openings may be in form of micro-holes, provided on at least a portion of the container surface; in form of slits between two (or more) metal members which, welded together through some welding spots, form the container; finally, in case the container is obtained by folding a single metal sheet, the openings may be the gaps between the folding lines or between two end portions of the metal sheet, folded on one another or towards one another.

Figure 2:
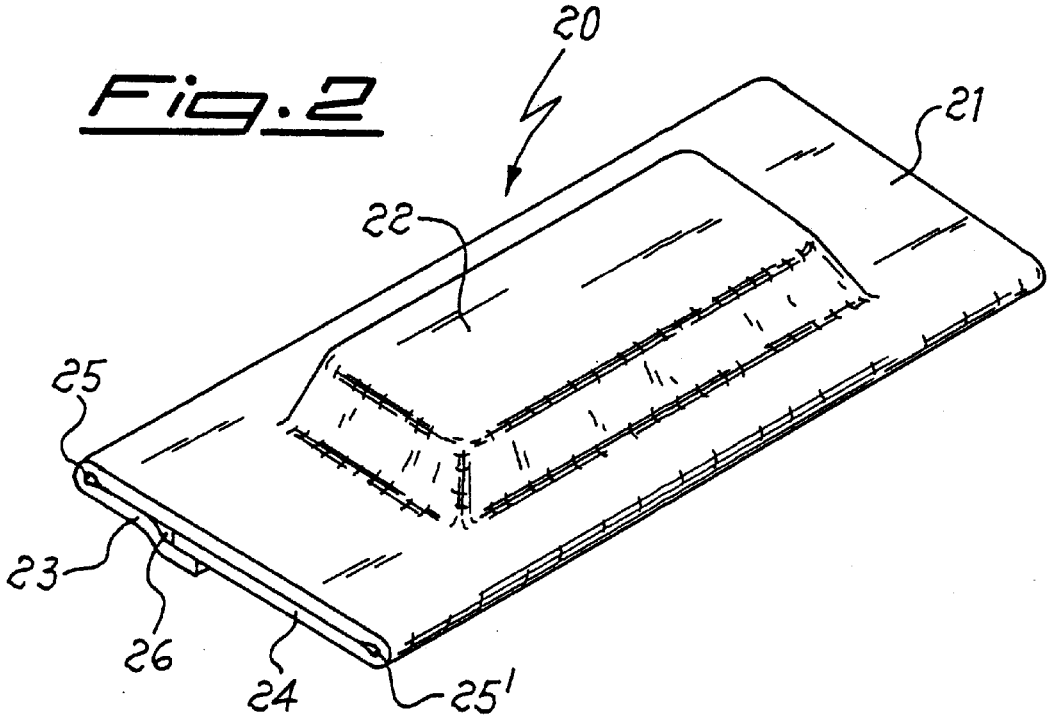
Figure 3:
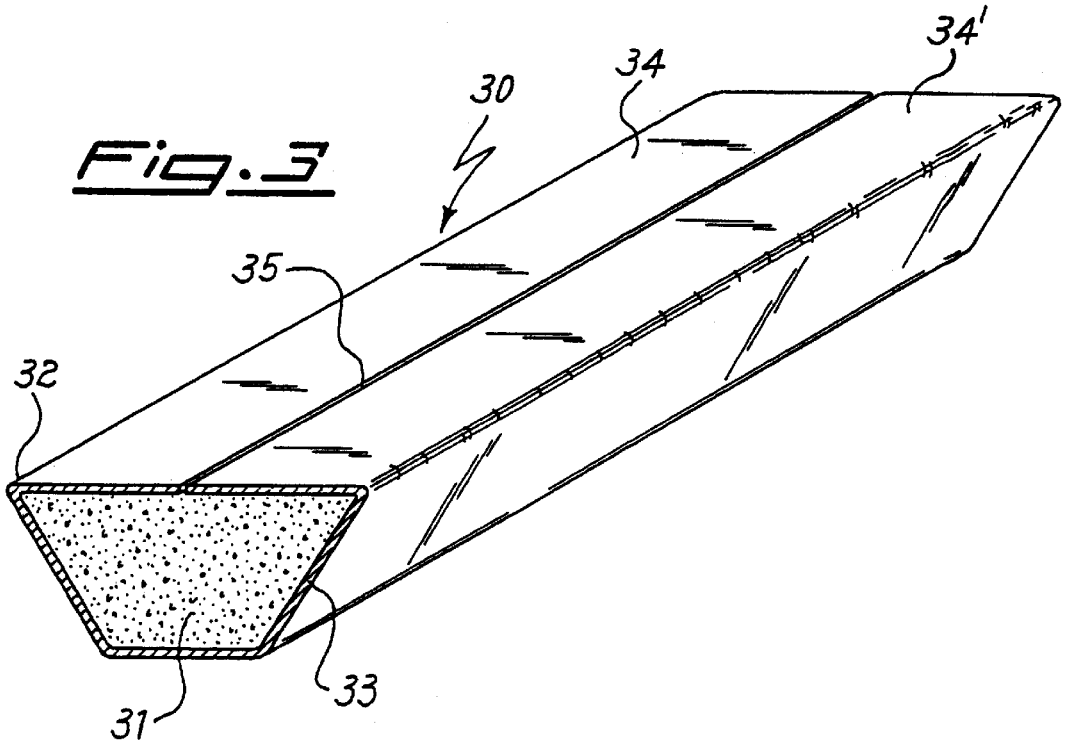

Some of these embodiments are represented in FIGS. 1–3.

FIG. 1 shows in cutaway a device 10 wherein container 11 is formed of two metal members, 12 and 13, welded together through some welding spots 14, 14", . . . ; inside the container there is a mercury releasing compound 15; between two successive welding spots there are some slits 16 (only one of which is shown in the figure) through which the mercury is discharged during the activation step; the device may further comprise a tang 17, for its fastening to an inner part of the lamp.

FIG. 2 shows another possible device 20 according to the invention, obtained by folding a metal sheet 21; in the middle portion of the sheet a hollow 22 is formed, intended to contain the powders of the mercury releasing compound, while two side end portions 23 and 24 of the sheet, are folded towards the middle, partially overlapping; by this assembling, there are some slits 25 and 25' along the folding lines of end portions 23 and 24, as well as a slit 26 on the end portions overlapping area.

In a preferred embodiment, the device of the invention has an elongated shape, with two similar linear dimensions and a third larger dimension. The device may have any section shape, e.g. circular, elliptical, square, rectangular or trapezoidal. A device of this type is shown in FIG. 3: device 30 contains powders 31 of the mercury releasing compounds, possibly in admixture with powders of other materials, inside a container 32 having an essentially trapezoidal section, obtained by folding along parallel lines a metal tape 33; the two end portions 34, 34', corresponding to the outmost portions of the starting metal tape, are folded such as to provide a thin slit 35; this shape is effective in retaining powders 31, while allowing the mercury vapors generated during the activation step to be released through slit 35. A device of this type, even having a different shape than the represented trapezoidal section, may be suitably obtained from a so-called continuous "wire", having an indefinite length and the same cross-section as the resulting device, by cutting "wire" pieces having the desired length. The continuous "wire" is easily produced, with methods known in the field, by having a metal tape of indefinite length pass through forming rolls suitably arranged, and by providing for a continuous loading step of powders 31, before the folding step wherein end portions 34, 34' are formed. The "wire" cutting for producing the device of the invention may be carried out by laser or mechanical techniques: in this latter case the cutting also slightly compresses the device ends, thus favoring the retaining of the powders.

The devices of the invention may be introduced into the lamps by mounting them onto one of the metal members usually provided therein, such as the supports of one or both the electrodes, called cathodes, or onto the metal shield provided in larger diameter lamps in order to prevent the blackening of the lamp inner surface zone close to the cathodes, according to modalities known to the lamp manufacturers. These shields often act as support for non-evaporable getter material, for controlling the gas atmosphere of the lamp. Particularly, devices of the type shown in FIG. 1 are preferably mounted onto the cathode supports, whereas devices having an elongated shape may be mounted either onto the cathode supports or onto their shield; finally, a device of the type shown in FIG. 3 may be introduced into small-size lamps, also acting as cathode, according to the modality hereinafter represented with reference to FIG. 6.

Figure 4:
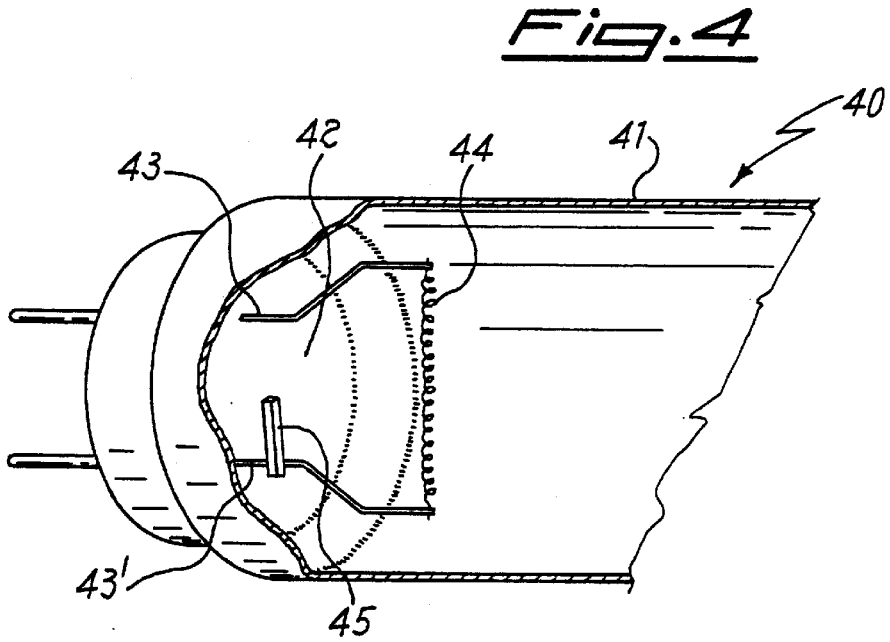
FIGS. 4 and 5 show two possible geometries for assembling the devices of the invention inside the lamps.
Figure 5:
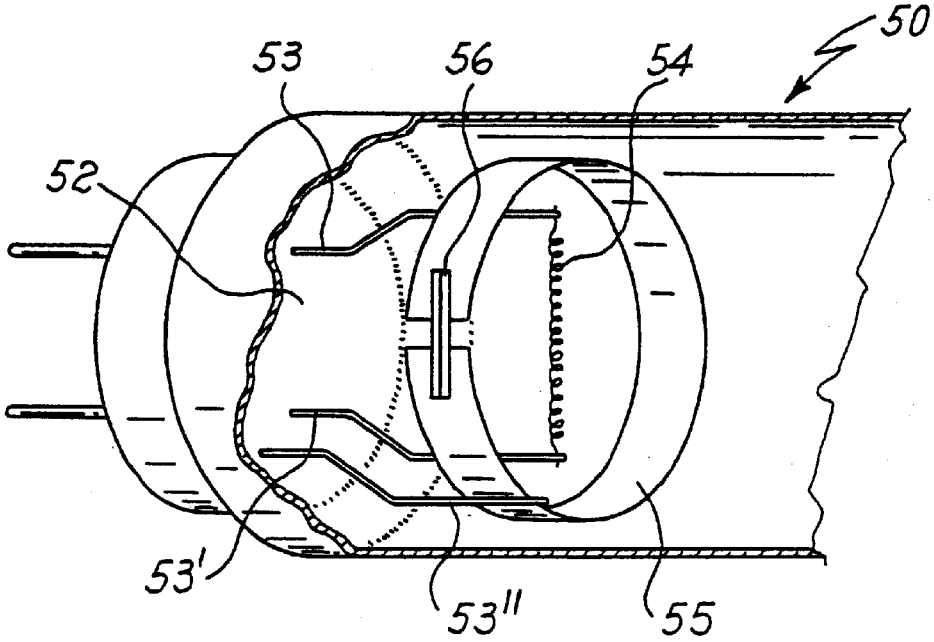
Figure 6:
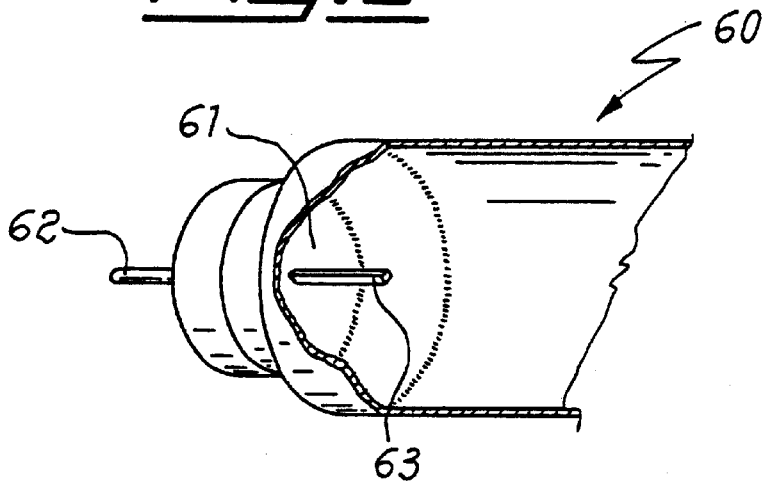
FIG. 6 shows an alternative assembling geometry of a device of the invention, wherein this latter also acts as cathode for the lamp working.

Some possible configurations for assembling the device of the invention into the lamps are represented in FIGS. 4–6.

FIG. 4 shows in cutaway the end portion of a lamp; lamp 40 is formed of a glass tube 41, closed at its end by a thicker glass member 42; two metal mountings 43, 43' are enclosed in the glass portion 42 by its melting and are passing through the same, thus forming the two electric contacts for supplying the current to cathode 44, formed e.g. of a metal coil, generally made of tungsten. A first assembling way for the device of the invention is shown in the drawing, wherein device 45 is shown fastened to one of the mountings (43') supporting cathode 44. The mercury releasing device of the invention may be fastened to the mounting e.g. by laser-welding;

FIG. 5, depicting in cutaway the end portion of a lamp 50, shows another possible assembling for the device: in this case a thicker glass member 52, closing the lamp, has inserted therein a third mounting 53", which is not passing-through with respect to member 52 and not in electric contact with mountings 53, 53'; mounting 53" has a shield 55 fastened thereon for the shielding of cathode 54; mercury releasing device 56 is fastened, e.g. through welding spots, to shield 55. The shield is in form of a cylindrical surface, obtained by folding a metal tape such that its ends are very close to one another or even touching or overlapping each other; in case the tape ends are not in mutual contact, mercury releasing device 56 may be fastened through some welding-spots bridging the two ends, as shown in the drawing; instead, in case the shield is already closed, having its ends in mutual contact and fastened together, device 56 may be fastened in any position onto the shield itself (this second configuration is not shown in the drawing).

FIG. 6 shows another possible configuration for assembling the mercury releasing device of the invention, suitable for small-size lamps wherein the cathode is formed simply of a wire piece or a little metal cylinder; by using a device having an elongated shape of the type described with reference to FIG. 3, and preferably having a circular section, it is possible to fasten the device directly onto the thicker glass portion at end 61 of lamp 60, perpendicularly thereto and in electric contact with a metal passing-through member 62, so that device 63 also acts as cathode.

The device activation is carried out by heating it from outside the lamp, once this is hermetically sealed. The heating may be carried out in several ways, but the method by induction is the most preferably used by the lamp manufacturers, since it allows a fast and selective heating of the metal members. The heating temperature and the treatment time may vary according whether there are alloys promoting the mercury release or not; generally the activation temperature ranges from about 600 to 900 ° C., with times ranging from about 20 to 60 seconds.

Figure 8:
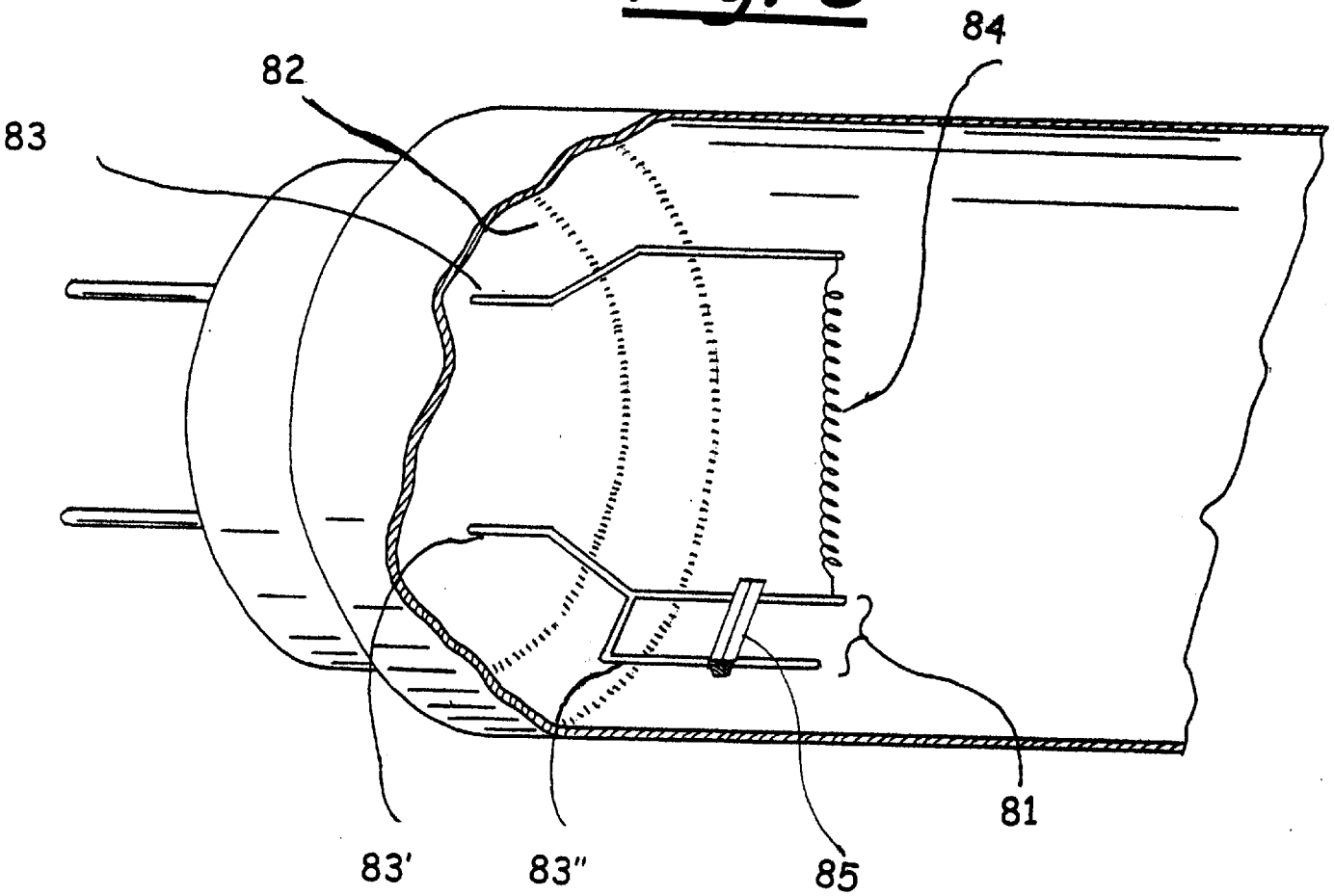
FIG. 8 shows another possible assembling geometry of a device according to the invention.

In case a device activation by induction is provided for, a special assembling of the mercury releasing device of the invention may be chosen, as disclosed, e.g., in patent GB 799921 in the applicant's name. In this case, as shown in FIG. 8, a "wire" piece 85 is mounted onto a metal bracket 81, supported, e.g., by a third mounting 83" which is not passing through with respect to the lamp glass housing 82. Analogous to the lamps shown in FIGS. 4 and 5, the cathode 84 is supported by two metal mountings 83, 83' which pass through the glass housing 82 to form the electrical contacts for supplying current to the cathode 84. The device of the invention is fastened through two spots onto the metal bracket 81, such as to form a closed metal circuit. This embodiment is especially advantageous when the device activation is carried out by induction heating with radio-frequencies in that the efficiency of the induction heating of a metal member depends upon its relative orientation with respect to the lines of the magnetic field: accordingly, when using devices such as those hereinbefore described, a non-reproducible behavior may be obtained during the activation in different production lines of the lamps. On the contrary, by using a device wherein the metal members form a closed circuit, a coupling with radio-frequencies is obtained independent of the orientation.

Figure 7A:
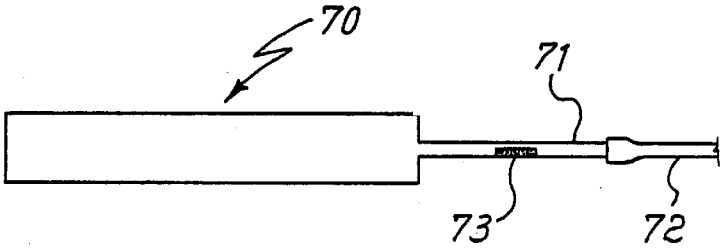
FIGS. 7*a*–7*e* show the steps of a process using a device of the invention for introducing mercury into a lamp
Figure 7B:
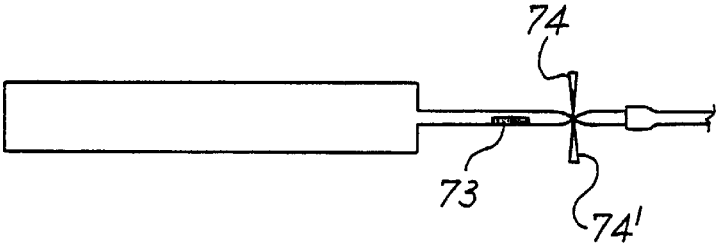
Figure 7C:
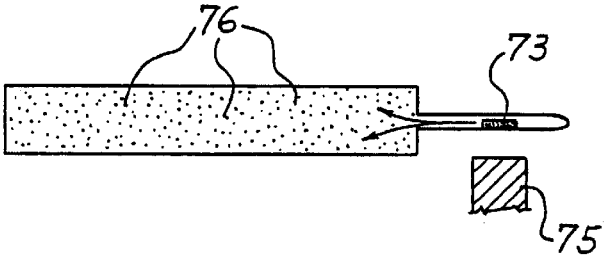
Figure 7D:
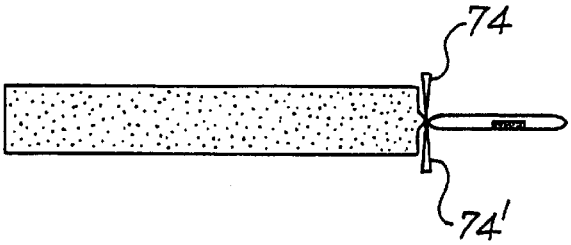
Figure 7E:
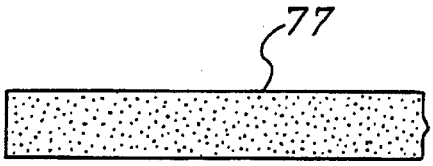

In all the above described embodiments, the device of the invention remains inside the lamp after the mercury is released. Alternatively, it is possible to use the device, particularly devices of the type shown in FIGS. 2 and 3, so that it does not remain in the resulting lamp. In this case the lamp is manufactured by a process defined in the field as "double pinch-off". With reference to FIG. 7*a*, the step is shown wherein a glass tube 70 is already closed at one end where electric passing-through members, cathode, possible shield or other members needed for the lamp working (none of which shown in the figure) are already present. Also the opposite end has fastened thereon all the members needed for the lamp working, but this part is still open through a "tail" 71, connected to a piping 72 for the lamp evacuation and backfilling with the gases, usually noble gases, contained in the fluorescent lamps. The "tail" has inserted therein a device 73 of the invention of suitable length. In the following process step represented in FIG. 7*b*, after having introduced in tube 70 the desired gas atmosphere, "tail" 71 is throttled, generally by hot compression with a tool schematically indicated by 74, 74', at a point between the connection to piping 72 and the zone having therein the device 73 of the invention. The hot throttling operation of the "tail" is defined in the field as "pinch-off". The following step, illustrated in FIG. 7*c*, is the activation of device 73, by means of an external heating member 75 that may be a hot body, a radiofrequency source or the like; the mercury vapor released in tube 70 is represented in the figure as element 76. After the activation step, the exhausted device 73 is separated from tube 70 by a second "pinch-off" operation, schematically shown in FIG. 7*d*, in this case carried out at a "tail" point as close as possible to the end of tube 70, and anyhow located between this end and the zone with device 73. Thus exhausted device 73 is detached from tube 70 and enclosed in a vial deriving from the starting "tail" 71. This results in a closed tube 77 represented in FIG. 7*e*, forming the resulting lamp.

The invention will be further illustrated by the following examples. These non-limiting examples illustrate some embodiments intended to teach those skilled in the art how to work the invention and to represent the best considered way to put the invention into practice.

EXAMPLES 1–3

Three similar samples of mercury releasing device according to the invention are prepared, in form of trapezoidal-section pieces as shown in FIG. 3, obtained from a continuous "wire" containing the $Ti_3Hg$ compound. The pieces have side dimensions 0.5×0.8 mm and are 10 mm long. The "wire" linear loading, predetermined during the production, is equal to 10.3 mg of $Ti_3Hg$ per centimeter, which comes to a nominal mercury loading of 6 mg per "wire" centimeter ($mg_{Hg}$/cm). Owing to the pieces length, each of them has a nominal mercury loading of 6 mg. The mercury release test is carried out on these samples, by induction heating them at 900° C. for 30 seconds inside a vacuum-chamber and by measuring the residual mercury in the samples with the method of complexometric titration according to Volhard. The mercury yield from the single samples, as % of released mercury with respect to the starting nominal mercury amount in each sample, is reported in Table 1.

EXAMPLES 4–6 (COMPARATIVE)

The test of Examples 1–3 is repeated on three samples obtained by cutting equal pieces, 10 mm long, from a metal tape having the $Ti_3Hg$ compound laminated thereon. The tape lamination with the $Ti_3Hg$ compound is carried out so as to have a mercury nominal linear loading equal to 6 $mg_{Hg}$/cm. The nominal mercury amount in each sample is thus equal to 6 mg. The mercury % yield of the three samples is reported in Table 1.

TABLE 1

| EXAMPLE | Hg % YIELD |
|---|---|
| 1 | 83.2 |
| 2 | 80.8 |
| 3 | 81.3 |
| 4 | 37.8 |
| 5 | 38.9 |
| 6 | 40.4 |

As the data in Table 1 show, the mercury releasing compound, $Ti_3Hg$, and the activation conditions being the same, the samples of the invention give a mercury yield twice as big as the samples of the prior art.

What is claimed is:

1. A device (10; 20; 30) for introducing small amounts of mercury into fluorescent lamps comprising, the device comprising:

(a) a powder (15; 31) of at least one mercury releasing compound selected from the group consisting of intermetallic $Ti_xZr_yHg_z$ compounds, wherein x and y range from 0 to 13, the sum x+y ranges from 3 to 13 and z is 1 or 2; and (b) a metallic container (11; 32) for retaining particles of the powder of the mercury releasing compound, the container being closed except for openings which are smaller than the particles but allow discharge of mercury vapors.

2. The device according to claim 1, wherein the mercury releasing compound is $Ti_3Hg$.

3. The device according to claim 1, wherein the powder of the mercury releasing compound has a particle size smaller than about 150 μm.

4. The device according to claim 1, wherein the powder of the mercury releasing compound also comprises a non-evaporable getter material.

5. The device according to claim 1, wherein the powder of the mercury releasing compound also comprises an alloy comprising copper and one or more elements selected from the group consisting of tin, indium, silver, silicon and rare earth elements.

6. The device according to claim 1, wherein the powder of the mercury releasing compound also comprises an inert material.

7. The device according to claim 1, wherein the metallic container is made of steel, nickel or nickeled iron.

8. The device according to claim 7, wherein the container is made of metal sheet having a thickness of 50–300 μm.

9. The device according to claim 1, wherein opening of the metallic container are micro-holes provided on at least a portion of a surface of the container.

10. The device (10) according to claim 1, wherein the metallic container is formed of two or more metal members welded together by spot-welding, and the metallic container has micro-holes (16) provided between welding spots (14, 14').

11. The device (20) according to claim 1, wherein the metallic container is formed of a folded metal sheet (21) with slits (25, 25', 26) between folding lines of the metal sheet or between two end portions (23, 24) of the metal sheet folded on one another or towards one another.

12. The device (30) according to claim 1, wherein the metallic container is formed from a continuous wire, being hollow to retain the powder particles and having a same cross-section as a resulting device, by cutting from the wire pieces having a desired length.

13. The device according to claim 12, wherein the mercury releasing device is formed of a wire piece welded through two spots onto a metal bracket, such that an assembly of the piece and the bracket forms a closed metal circuit.

14. A fluorescent lamp (40; 50; 60; 77) comprising a mercury releasing device which comprises a powder (15; 31) of at least one mercury releasing compound selected from the group consisting of intermetallic $Ti_xZr_yHg_z$ compounds, wherein x and y range from 0 to 13, the sum x+y ranges from 3 to 13 and z is 1 or 2, and a metallic container (11; 32) for retaining particles of the powder of the mercury releasing compound, the container being closed except for openings which are smaller than the particles but allow discharge of mercury vapors.

15. The fluorescent lamp (40) according to claim 14, wherein the mercury releasing device (45) remains in the lamp and is fastened to a support (43, 43') supporting a cathode (44).

16. The fluorescent lamp according to claim 14, wherein the mercury releasing device remains in the lamp and is fastened to a support supporting a cathode shield.

17. The fluorescent lamp (50) according to claim 14, wherein the mercury releasing device (56) remains in the lamp and is fastened to a cathode shield (55).

18. The fluorescent lamp (60) according to claim 14, wherein the mercury releasing device (63) forms a lamp cathode.

19. The fluorescent lamp (77) according to claim 14, wherein the lamp is adapted to allow separation of the mercury releasing device (74) from the lamp by a double pinch-off process.

20. The device (10; 20; 30) according to claim 1, wherein the openings of the metallic container (11; 32) are slits on a surface of the container for allowing the release of mercury vapor.

* * * * *